US006308365B1

(12) United States Patent
Huang

(10) Patent No.: US 6,308,365 B1
(45) Date of Patent: Oct. 30, 2001

(54) TOOTHBRUSH FOR FALSE TEETH

(75) Inventor: Cheng-Ho Huang, Taipei Hsien (TW)

(73) Assignee: Shuang-Ho-E Co., Ltd., Taipei (TW)

( * ) Notice: Subject to any disclaimer, the term of this patent is extended or adjusted under 35 U.S.C. 154(b) by 0 days.

(21) Appl. No.: 09/580,268

(22) Filed: May 26, 2000

Related U.S. Application Data

(63) Continuation-in-part of application No. 09/294,550, filed on Apr. 20, 1999, now Pat. No. 6,131,231.

(30) Foreign Application Priority Data

Apr. 4, 2000 (CN) ..... 00 2 31048

(51) Int. Cl.[7] ..... A46B 5/02
(52) U.S. Cl. ..... 15/106; 15/143.1; 15/167.1
(58) Field of Search ..... 15/106, 143.1, 15/167.1

(56) References Cited

U.S. PATENT DOCUMENTS

| | | | |
|---|---|---|---|
| 1,510,898 | * | 10/1924 | Nikicser . |
| 2,021,158 | | 11/1935 | Stearns . |
| 2,633,591 | | 4/1953 | Servilla . |
| 2,914,785 | | 12/1959 | Ela . |
| 3,067,446 | | 12/1962 | McGauley . |
| 5,351,358 | | 10/1994 | Larrimore . |
| 5,465,449 | * | 11/1995 | Lewkowicz . |
| 5,517,713 | | 5/1996 | Hadcock . |
| 6,112,357 | * | 9/2000 | Halloran . |

FOREIGN PATENT DOCUMENTS

| | | | |
|---|---|---|---|
| 223751 | * | 1/1943 | (CH) . |
| 1238531 | * | 7/1960 | (FR) . |
| 196193 | * | 4/1923 | (GB) . |
| 240586 | | 10/1925 | (GB) . |
| 476186 | * | 12/1937 | (GB) . |

* cited by examiner

*Primary Examiner*—Randall E. Chin
(74) *Attorney, Agent, or Firm*—Bacon & Thomas

(57) ABSTRACT

A toothbrush for false teeth includes first and second sets of bristles respectively implanted in a bottom face and a top face of a brush head, and a handle integrally formed with the brush head, the handle having a first and second recesses defined in a first side and a third recess defined in a second side face opposite the first side. The recesses arranged such that the brush can be gripped using just the index and middle fingers, and the thumb, in either of two positions, one of which is especially suitable for cleaning surfaces of the teeth, and the other of which is especially suitable for cleaning metal parts and gaps in the false teeth.

12 Claims, 6 Drawing Sheets

TOOTHBRUSH FOR FALSE TEETH

CROSS REFERENCE

This application is a continuation inpart (CIP) of the patent application Ser. No. 09/294,550, filed on Apr. 20, 1999, by Huang now U.S. Pat. No. 6,131,231.

BACKGROUND OF THE INVENTION

1. Field of the Invention

The invention relates to a toothbrush, and more particularly to a toothbrush for false teeth. The toothbrush has a first set of bristles and a second set of bristles respectively implanted on opposite faces of a head section of a handle. One face of the head section is inclinded, the lengths of the bristles in the second set of bristles varies to form a taper, and the lengths of the bristles in the first set of bristles varies to form undulations, such that the brush is able to be used to brush not only the surfaces of the false teeth, but also the metal parts that engage other natural teeth, and the gaps between the false teeth.

2. Prior Art Description

Normally, a user uses a toothbrush to brush his/her false teeth. However, because the toothbrush is too big to brush all the small areas in the false teeth, a specifically designed brush is required to brush the false teeth. In order to obviate this shortcoming, patents related to the toothbrush designed for false are presented to the public. For example, U.S. Pat. No. 2,021,158 ('158) relates to an improved handle construction for implements such as a device used in treatment of skin and which may be applied to toothbrush construction, the objective being to provide a handle construction which permits greater preasure to be applied to the device during manual operation thereof and to provide a light, easily constructed operating means for implements such as toothbrushes which permits the use thereof with both hands simultaneously. It is noted from the attached drawins and especially FIG. 1 of '158 patent that the implement operating means has an ergonomic grip portion, and comprises a brush head (2) having a flat shape, one side of which has implanted hairs (3), as well as a handle (11) attached to one side of the head via arms (8), and two protrusions formed by two grooves (27) on ends of the upper surface of the handle with a concave portions formed therebetween. The '158 patent needs at least two arms (8) to engage the handle with the brush head (2) and, furthermore, the handle (11) is a combination of two parts, one of which has a dowel (12) and the other of which has an aperture defined to received the dowel (12) therein. Accordingly, it is very possible that the two combined parts of the handle (11) will separate into two different parts while in use. The arms (8), perferably made of stainless steel, makes operation of the implement difficult and have a great weigh so that it is quite awkward to use a brush of this type to brush things such as false teeth. Moreover, the brush head has only one side implanted with hairs, which makes the function of the brush limited in a certain aspect.

In order to obviate the aforemention problems, the present invention tends to introduce an improved toothbrush especially designed for false teeth.

SUMMARY OF THE INVENTION

The primary objective of the present invention is to provide an improved toothbrush for false teeth. The toothbrush of the invention has two different sets of bristles respectively implanted on opposite sides of the brush head, wherein one side of the brush head is inclined and provided with a tapered set of bristles, and the other side of the brush head is provided with an undulating set of bristles. With such an arrangement, the toothbrush is able to be used to brush any area of the false teeth, including the metal part which connects the false teeth to the real teeth.

Other objective of the invention will be clear after the detailed description. of the package with the reference of the accompanying drawings.

BRIEF DESCRIPTION OF THE INVENTION

The present invention will be better understood with the description to the following drawings, wherein.

DETAILED DESCRIPTION OF THE PREFERRED EMBODIMENT

Figure 1:
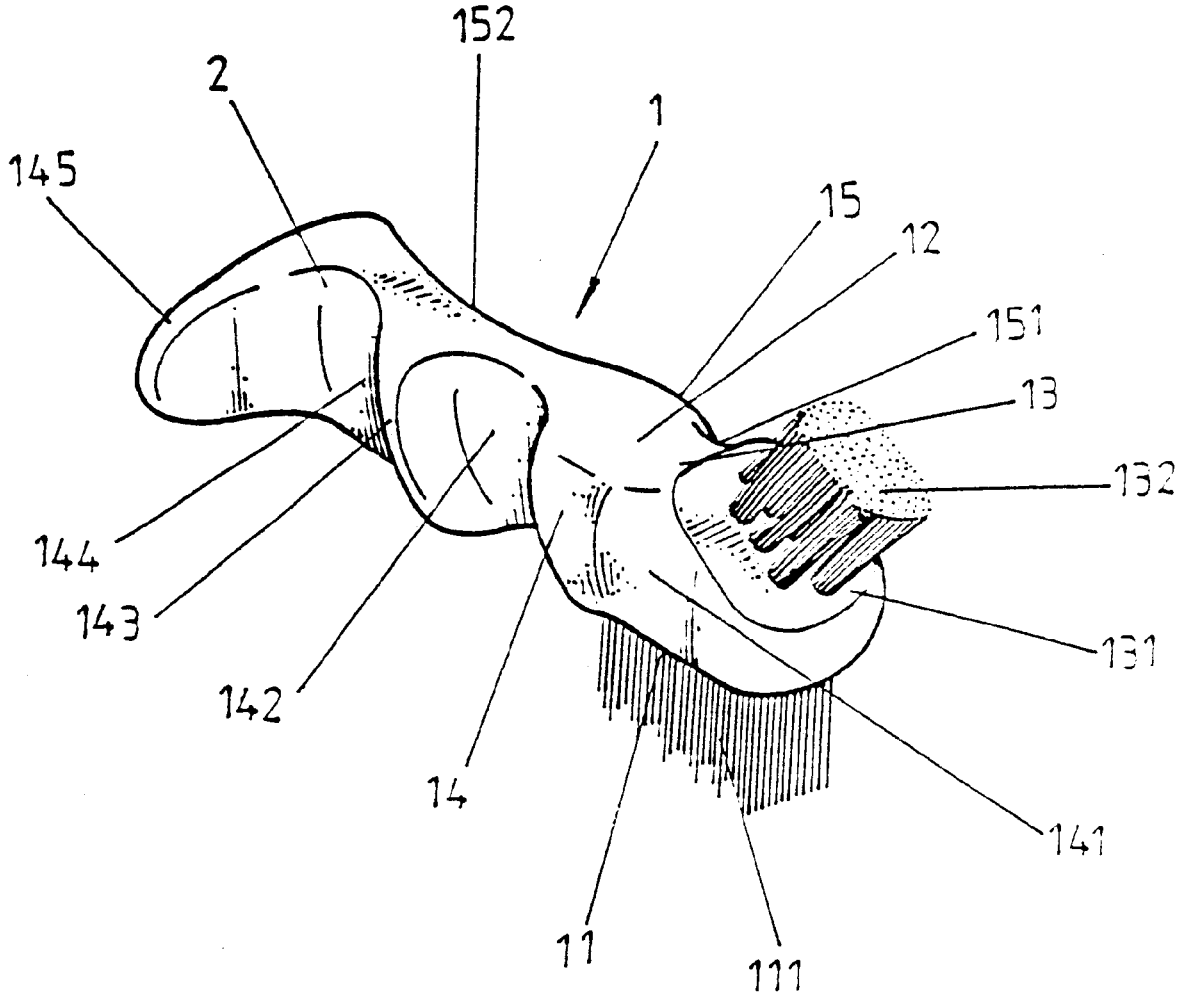
FIG. 1 is a perspective view of the preferred embodiment of the toothbrush in accordance with the present invention.
Figure 2:
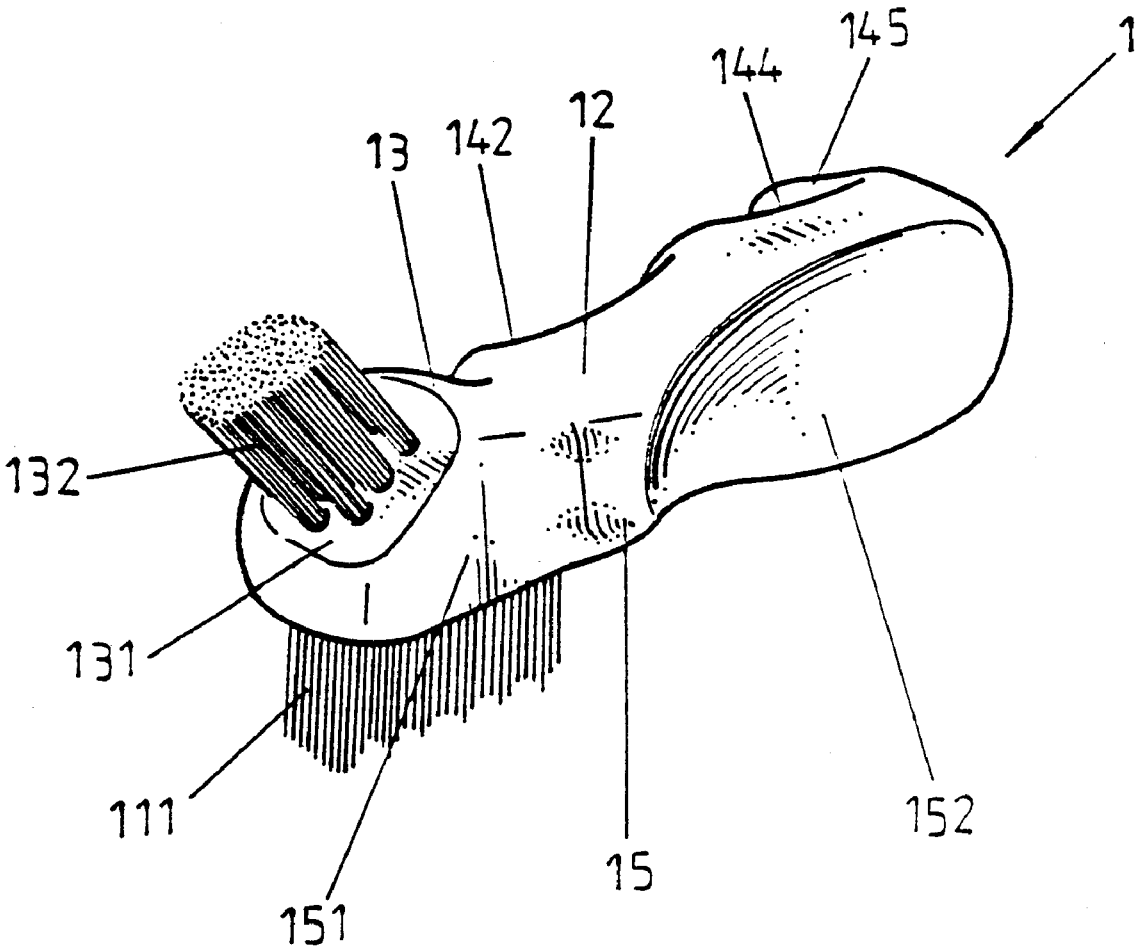
FIG. 2 is a perspective view of the toothbrush in FIG. 1 in another angle.
Figure 3:
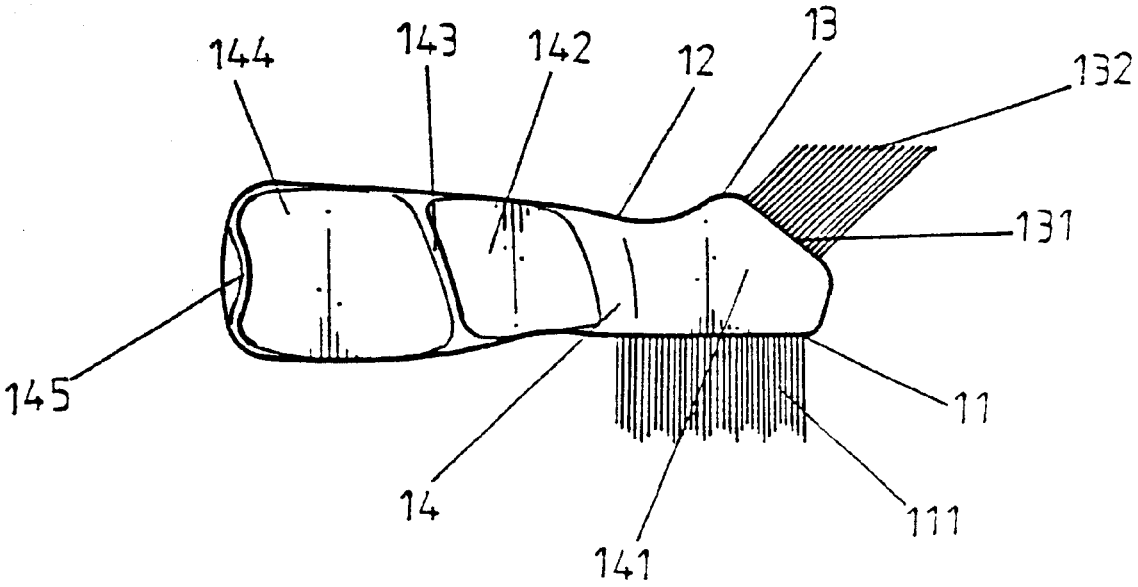
FIG. 3 is a side plan view of the toothbrush of the invention.

With reference to FIGS. 1, 2, and 3, it is to be noted that the toothbrush (1) in accordance with the present invention has a brush head (11) and a handle (12) integrally formed with the brush head (11). The brush head (11) has a first set of bristles (111) implanted in a bottom face thereof and a second set of bristles (132) implanted in a sloped face (131) extending from a protrusion (13) on a top face of the brush head (11). The lengths of the bristles in the first set of bristles (111) vary in a periodic manner to form undulations and the lengths of the bristles in the second set of bristles (132) taper toward the protrusion (13), i.e., the bristles of the second set decrease in length from one end of the set to the other to form a taper in the direction of the protrusion. Opposite cambered side faces (14, 15) of the brush head (11) respectively have an arcuate recess (141, 151).

On the side face (14) of the handle (12), first and second recesses (142,144) are defined side by side, and a spacer (143) is formed therebetween and slopes toward the first recess (142). An abutting end (145) is formed on the end of the handle (12) and adjacent the second recess (144). The length of the abutting end (145) is the same as that of the spacer (143). A third recess (152) is formed on the cambered side face (15) and has a width the same as that of the sum of the first and the second recesses (142,144). In order to increase the friction of holding, a plurality of rubber strips (2) may be formed in the first, second and/or third recesses (142,144,152).

Figure 4:
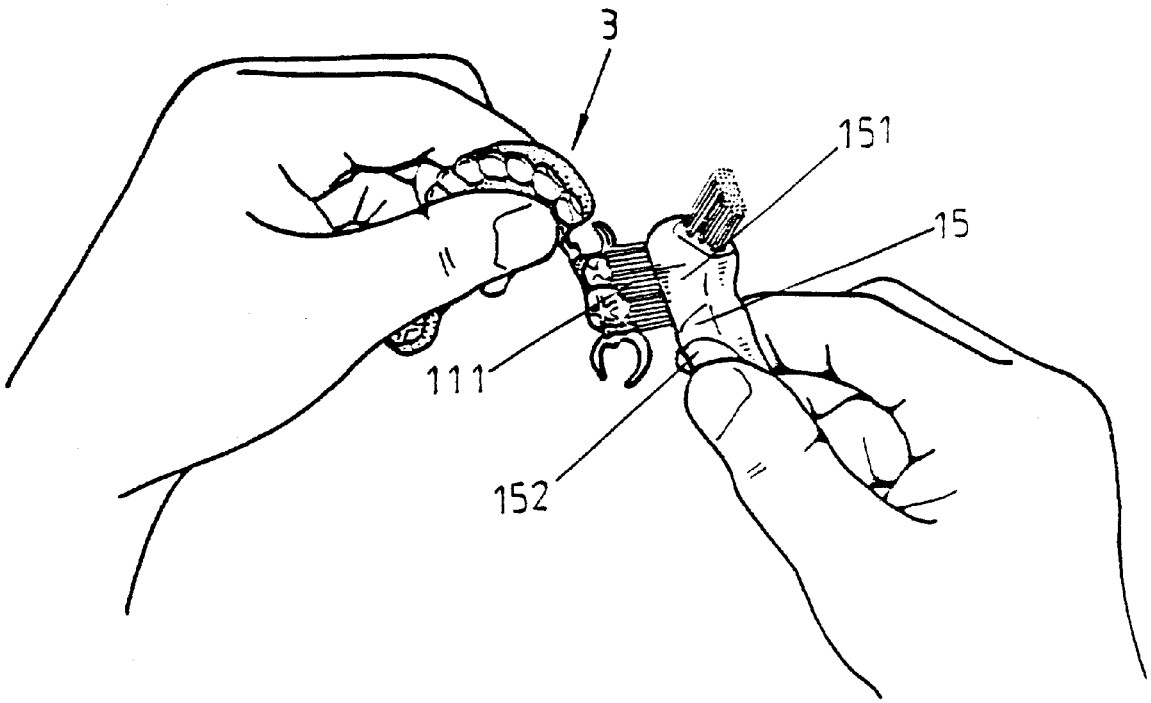
FIG. 4 shows the application of the toothbrush of the invention with one set of the bristle.
Figure 5:
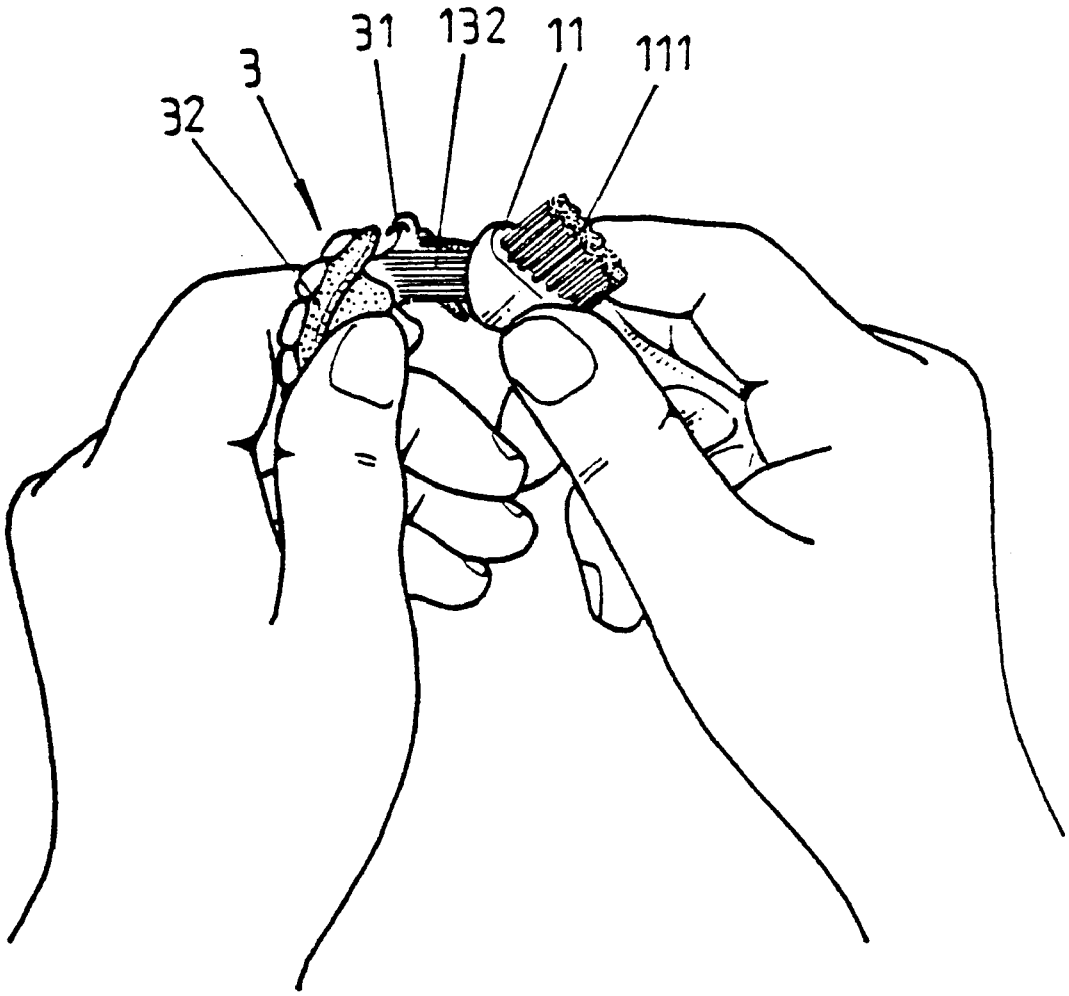
FIG. 5 shows the application of the toothbrush with another set of the bristle.
Figure 6:
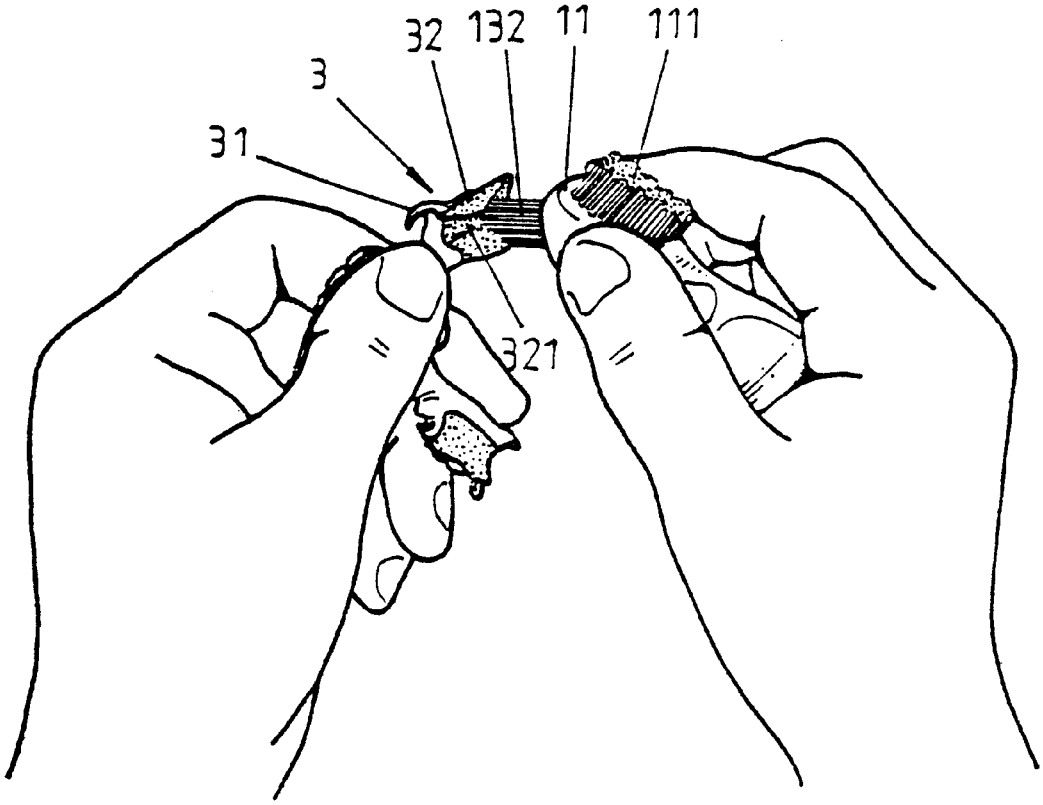
FIG. 6 still shows the application of the toothbrush in cleaning the apertures in the false teeth.

With reference to FIGS. 4, 5, and 6, when the toothbrush of the invention is in use for a pair of false teeth, the thumb of the user rests in the third recess (152) and the index and the middle finger of the user are respectively located in the second and the third recesses (142,144). Because of the spacer (143) provided to separate the index finger and the middle finger, and the abutting end (145) abutted by the ring finger, the user is able to use the first set of bristles (111) to brush the metal parts of and the gaps between the false teeth. When the toothbrush of the invention is to be used to brush the surface of the false teeth, the thumb of the user can be placed in the first recess (142) and the index and the middle fingers are placed in the third recess (152). Furthermore, the second set of bristles (132) can also be used to clean the deep hollow area within the false teeth.

It is concluded that the toothbrush of the invention has the following advantages:

Two sets of bristles provide convenience to the user in that the user will not have to prepare a different toothbrush for different parts on the false teeth. The cambered side faces, the spacer and the abutting end further provide a comfortable grip for the user. Furthermore, the sloped face and the tapered length second set of bristles provide easier cleaning operation and movement of the brush.

It is to be understood, however, that even though numerous characteristics and advantages of the present invention have been set forth in the foregoing description, together with details of the structure and uanction of the invention, the disclosure is illustrative only, and changes may be made in detail, especially in matters of shape, size, and arrangement of parts within the principles of the invention to the fully extent indicated by the broad general meaning of the terms in which the appended claims are expressed.

What is claimed is:

1. A toothbrush for false teeth, comprising:

a brush head having a bottom face, a top face, and side faces, said side faces extending between the bottom and top faces, said brush head further including a first set of bristles implanted on the bottom face and a second set of bristles implanted on the top face; and a handle integrally formed with the brush head, said handle including a first side face and a second side face that extend from and are generally parallel to respective said side faces of the brush head, first and second recesses defined in said first side face, and a third recess defined in said second side face at a position opposite the first and second recesses, and an abutting end formed on an end thereof and adjacent to the second recess, wherein said first and second recesses are arranged to respectively accommodate an index finger and a middle finger of a person using the brush, and said third recess is arranged to simultaneously accommodate a thumb of said person so as to enable metal parts and gaps between the false teeth to be brushed, and wherein said first recess is also arranged to accommodate the thumb of the user and the third recess is also arranged to simultaneously accommodate the index finger and the middle finger of the user so as to enable surfaces of said false teeth to be brushed.

2. The toothbrush as claimed in claim 1, wherein the brush head further has a first cambered side face with a first arcuate surface and a second cambered side face with a second arcuate surface, said second cambered side face being positioned opposite the first cambered side face.

3. The toothbrush as claimed in claim 2, wherein the brush head further has a protrusion formed on said top face and a sloped surface extending from the protrusion and having the second set of bristles implanted thereon.

4. The toothbrush as claimed in claim 3, wherein lengths of bristles in the second set of bristles vary such that tips of said bristles collectively for a tapered brushing surface, and said tapered brushing surface slopes away from the protrusion.

5. The toothbrush as claimed in claim 3, wherein the sloped surface is inclined at an angle of 45° relative to the protrusion.

6. The toothbrush as claimed in claim 1, wherein lengths of bristles in the first set of bristles vary such that tips of said bristles collectively form an undulating brushing surface.

7. The toothbrush as claimed in claim 1, wherein lengths of bristles in the second set of bristles vary such that tips of said bristles collectively form a tapered brushing surface.

8. The toothbrush as claimed in claim 7, wherein the tapered brushing surface is inclined at an angle of 45° toward the protrusion.

9. The toothbrush as claimed in claim 1, wherein a width of the third recess equals a sum of the widths of the first and the second recesses.

10. The toothbrush as claimed in claim 1, wherein a plurality of rubber strips are formed on the first recess.

11. The toothbrush as claimed in claim 1, wherein a plurality of rubber strips are formed on the second recess.

12. The toothbrush as claimed in claim 1, wherein a plurality of rubber strips are formed on the third recess.

* * * * *